United States Patent [19]

Cooper et al.

[11] 4,156,635

[45] May 29, 1979

[54] ELECTROLYTIC METHOD FOR THE PRODUCTION OF LITHIUM USING A LITHIUM-AMALGAM ELECTRODE

[75] Inventors: John F. Cooper, Castro Valley; Oscar H. Krikorian, Danville; Robert V. Homsy, Oakland, all of Calif.

[73] Assignee: The United States of America as represented by the United States Department of Energy, Washington, D.C.

[21] Appl. No.: 891,355

[22] Filed: Mar. 29, 1978

[51] Int. Cl.[2] ..... C25C 3/02

[52] U.S. Cl. ..... 204/68

[58] Field of Search ..... 204/68

[56] References Cited

U.S. PATENT DOCUMENTS

| | | | |
|---|---|---|---|
| 2,148,404 | 2/1939 | Gilbert | 204/68 |
| 2,234,967 | 3/1941 | Gilbert | 204/68 |

*Primary Examiner*—Howard S. Williams

*Attorney, Agent, or Firm*—Roger S. Gaither; Irene S. Croft; William S. Bernheim

[57] ABSTRACT

A method for recovering lithium from its molten amalgam by electrolysis of the amalgam in an electrolytic cell containing as a molten electrolyte a fused-salt consisting essentially of a mixture of two or more alkali metal halides, preferably alkali metal halides selected from lithium iodide, lithium chloride, potassium iodide and potassium chloride. A particularly suitable molten electrolyte is a fused-salt consisting essentially of a mixture of at least three components obtained by modifying an eutectic mixture of LiI-KI by the addition of a minor amount of one or more alkali metal halides. The lithium-amalgam fused-salt cell may be used in an electrolytic system for recovering lithium from an aqueous solution of a lithium compound, wherein electrolysis of the aqueous solution in an aqueous cell in the presence of a mercury cathode produces a lithium amalgam. The present method is particularly useful for the regeneration of lithium from the aqueous reaction products of a lithium-water-air battery.

15 Claims, 1 Drawing Figure

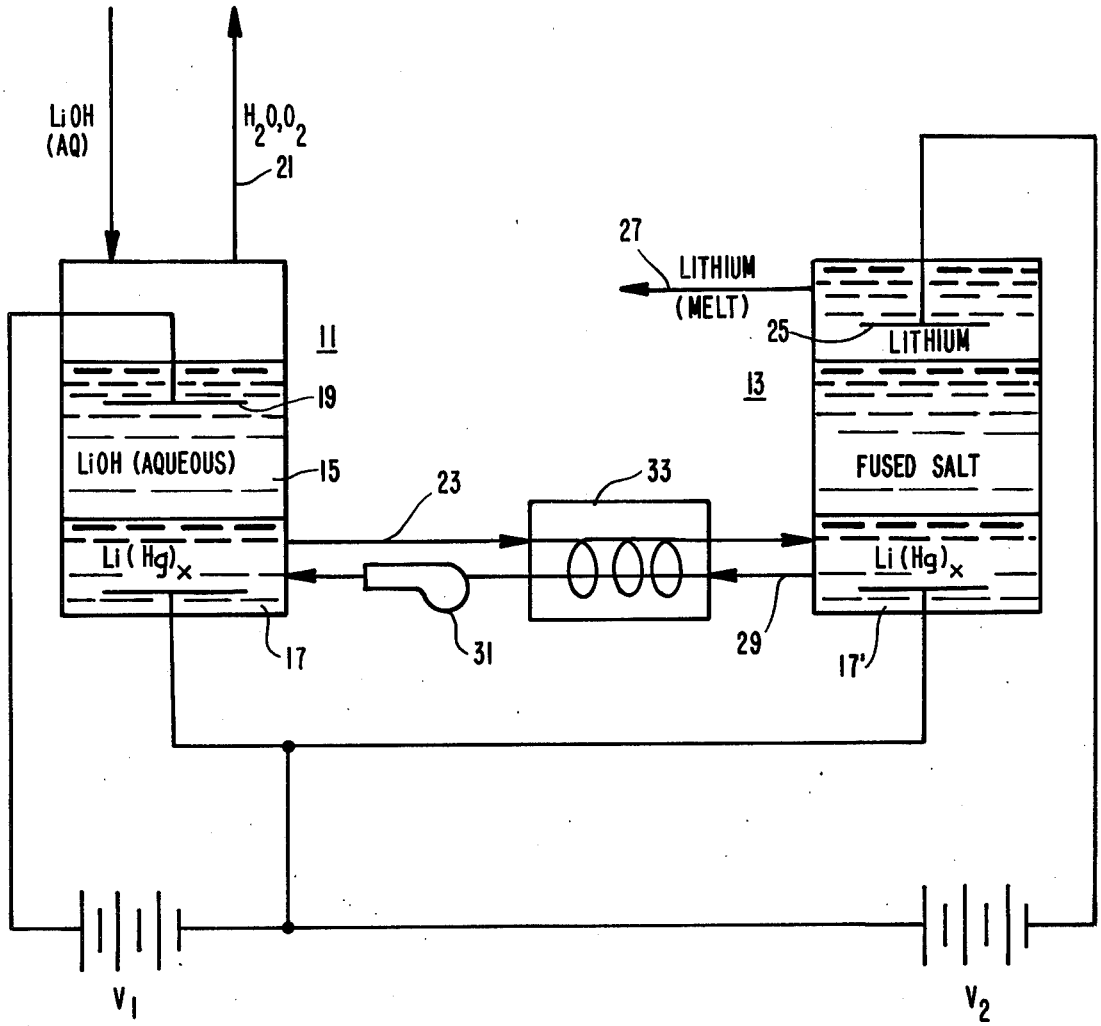
LiOH
(AQ)
$H_2O,O_2$
21
27
LITHIUM
(MELT)
25
LITHIUM
11
13
19
LiOH (AQUEOUS)
15
23
33
FUSED SALT
Li(Hg)x
Li(Hg)x
17
31
29
17'
V1
V2

ELECTROLYTIC METHOD FOR THE PRODUCTION OF LITHIUM USING A LITHIUM-AMALGAM ELECTRODE

BACKGROUND OF THE INVENTION

The invention described herein was made at Lawrence Livermore Laboratory in the course of or under United States Department of Energy Contract No. W-7405-ENG-48 with the University of California.

This invention relates to an electrolytic method for the recovery of lithium from its amalgam. More particularly, this invention relates to the recovery of lithium from a lithium-amalgam which is produced by electrolysis of an aqueous solution of a lithium compound in the presence of a mercury cathode.

The feasibility of using a lithium-water-air battery as an automotive power source for electric vehicles depends, at least in part, on an efficient process for regenerating lithium from battery reaction products. It is known that alkali metals, such as sodium and/or potassium, may be recovered from their aqueous solutions by electrolysis in the presence of a mercury cathode, whereby the corresponding alkali metal amalgam is formed; and that the alkali metal may then be recovered electrolytically from the amalgam using a fused-salt mixture as an electrolyte. The latter process requires a high-ionic-conductivity, fused-salt electrolyte which is chemically stable in the presence of the alkali metal being recovered and which is relatively low melting so that the vapor pressure of the mercury is minimized.

Heredy, U.S. Pat. No. 3,472,745 and Heredy, U.S. Pat. No. 3,472,746, describe an electrolytic process for recovering sodium and/or potassium from the corresponding amalgam using as molten electrolyte a low-melting ternary salt mixture containing as an essential ingredient the corresponding alkali metal amide. However, amides are unstable in the presence of lithium and, consequently, the Heredy process is not suitable for application to lithium recovery.

The current industrial technique for lithium production employs a high temperature (400°–500°C.) fused-salt (LiCl-KCl) electrolysis cell with purified, anhydrous LiCl feed; the total energy efficiency is approximately 20–40%.

SUMMARY OF THE INVENTION

In accordance with the present invention, it has been found that lithium is efficiently recovered from its molten amalgam by using as molten electrolyte a fused-salt consisting essentially of a mixture of at least two alkali metal halides. The alkali metal halides which may be used in the present invention are those formed from ions selected from $Cs^+$, $Li^+$, $Na^+$, $K^+$, $F^-$, $Cl^-$, $Br^-$, and $I^-$, in particular, alkali metal halides selected from lithium iodide, lithium chloride, potassium iodide, and potassium chloride. Since it is desirable that the molten electrolyte have a melting point as low as possible, an eutectic mixture of halides is preferred. A particularly suitable molten electrolyte is a mixture of at least three components consisting essentially of a major proportion of a LiI-KI mixture, in eutectic or near eutectic proportions, and one or more alkali metal halides, preferably lithium or potassium chlorides or bromides, in minor amounts. In a specific embodiment of the invention, an eutectic composition of about 8 mol% LiCl, about 42 mol% KI, and about 50 mol% LiI, m. p. <250° C. is used as the molten salt.

In a particular embodiment of the present invention, the lithium amalgam is produced by electrolysis of an aqueous solution of a lithium salt, for example, lithium hydroxide, in the presence of a mercury cathode. The resulting amalgam is circulated between the aqueous cell and a fused-salt cell as described above and serves as a bipolar electrode. This embodiment of the invention is particularly applicable to the regeneration of lithium from the aqueous reaction products of a lithium-water-air battery.

It is, therefore, an object of this invention to provide an electrolytic process for the recovery of lithium from its amalgam.

It is another object of this invention to provide an electrolytic process for the recovery of lithium from an aqueous salt solution thereof.

A particular object of this invention is to provide an efficient method for the regeneration of lithium from the aqueous reaction products of a lithium-water-air battery.

Other objects and advantages will become apparent from the following description made with reference to the accompanying drawing.

BRIEF DESCRIPTION OF THE DRAWING

The accompanying FIGURE is a schematic representation of an electrolytic system for use in a particular embodiment of the present invention.

DETAILED DESCRIPTION OF THE INVENTION

In the accompanying drawing there is depicted an aqueous electrolyte cell 11 (stage I) and a fused-salt cell 13 (stage II). A concentrated aqueous solution of a lithium salt, such as LiOH, is supplied continuously to electrolyte compartment 15 in cell 11. Upon the application of current, the lithium ions are electrochemically reduced at the LiOH-amalgam interface to form lithium amalgam in region 17. Simultaneously, at the aqueous lithium hydroxide solution-anode interface 19, the hydroxyl ions are oxidized to form water-saturated oxygen gas, which is then removed from the cell by means of line 21.

The lithium-rich amalgam in region 17 is continuously introduced by means of line 23 into region 17' of cell 13. The lithium amalgam forms a planar cathode surface in cell 11 and a planar anode surface in cell 13. In cell 13, at the planar anode surface, the lithium in the amalgam is reduced to lithium ion which migrates through the fused-salt electrolyte to the cathode 25 where it is oxidized to molten lithium. This molten lithium may be conveniently removed by line 27. The amalgam in region 17' thus becomes depleted in lithium, and this lean amalgam is continuously introduced into cell 11 by means of line 29 and pump 31, in countercurrent heat exchange with the amalgam stream in line 23 in heat exchanger 33. Thus, the lithium amalgam circulates continuously between cells 11 and 13 in countercurrent flow and acts as a bipolar electrode.

The reactions which take place in the system may be represented by the following equations:

(1) Aqueous cell $$4LiOH + 4xHg \rightarrow 4Li(Hg)_x + O_2 + 2H_2O$$

(2) Fused-salt cell $$4Li(Hg)_x \rightarrow 4Li + 4xHg$$

The molten electrolyte in cell 13 consists essentially of a mixture of two or more alkali metal halides, preferably selected from lithium iodide, lithium chloride, potassium iodide, and potassium chloride. Desirably, the cell is operated at as low a temperature as feasible, since this minimizes energy loss, mercury loss, and contamination of lithium by mercury; therefore, an eutectic composition is preferred. The cell may be operated at a temperature below about 250° C. by using as the molten salt an eutectic or near eutectic mixture of LiI-KI (m.p., 260° C.) modified by the addition of a minor amount of one or more alkali metal halides, particularly lithium or potassium chlorides or bromides.

The aqueous cell may be operated at a temperature in the range of about 0°–100° C. It has been found that the concentration of Li in the amalgam corresponding to saturation (i.e., 1.33 at% Li at 25° C.) can be exceeded by a factor of four without serious loss of Faradaic efficiency. However, the maximum concentration for efficiencies in excess of 90% falls off with increasing temperature. Therefore, it is preferred to operate the aqueous cell at less than about 55° C.

The current densities may be varied over a large range. Faradaic efficiency tends to increase with current density at a fixed amalgam concentration. A Faradaic efficiency approaching 100% can be achieved by operating with a current density greater than about 100% mA/cm$^2$. It is proposed that the present process be carried out in the range of 100 mA/cm$^2$ to 1 A/cm$^2$.

It is important to stir the amalgam during the process. This can be accomplished by suitable impellors or by shaking.

The following example is illustrative of the present invention.

EXAMPLE

A concentrated lithium hydroxide solution (5.3 M) is electrolyzed at a temperature of 45° C. in an aqueous cell having a lithium-amalgam cathode and an oxygen on nickel anode. The cathode electrode terminal is fabricated of nickel. An average current density of about 100 mA/cm$^2$ is used during the electrolysis. Cell voltage is allowed to float and is about 3 volts. The lithium concentration of the amalgam entering the cell is of the order of about 0.1 at%, and the concentration on leaving the cell is about 1.3 at%. Oxygen is evolved at the anode. Water is also formed at the anode.

The lithium-amalgam is fed into a fused-salt cell equipped with nickel electrode terminals. The cell is charged with the eutectic ternary-salt mixture consisting of 8 mol% LiCl, 42 mol% KI, and 50 mol% LiI, m. p. <250° C. The cell is operated at a temperature 10° C. above the melting point. The lithium amalgam circulates continuously between the aqueous cell and the fused-salt cell. A current density of about 100 mA/cm$^2$ is used during the electrolysis; operating cell voltage is 1.1–1.5 V. In the fused-salt cell, the amalgam is electrolytically refined to a pure lithium melt.

Efficiencies of 81–87% can be achieved by the process of the present invention. Thus, it has been shown that the present process provides a method for the electrolytic recovery of lithium from its amalgam using a molten-salt electrolyte, which is thermodynamically stable with respect to lithium and which has high electrical conductivity and a relatively low melting point. As a consequence, loss of mercury is minimized and lithium is obtainable at a considerably enhanced energy efficiency compared with methods heretofore available.

Although the invention has been described with reference to a specific example, various changes and modifications will become apparent to those skilled in the art.

What we claim is:

1. A method for recovering lithium from a molten lithium amalgam which comprises employing said amalgam as an anode in an electrolysis cell which contains as molten electrolyte a fused-salt consisting essentially of a mixture of at least two alkali metal halides.

2. The method as in claim 1 wherein the alkali metal halides are formed from ions selected from $Cs^+$, $Li^+$, $Na^+$, $K^+$, $F^-$, $Cl^-$, $Br^-$, and $I^-$.

3. The method as in claim 2 wherein the alkali metal halides are selected from lithium iodide, lithium chloride, potassium iodide and potassium chloride.

4. The method as in claim 2 wherein the fused-salt is a mixture of at least three alkali metal halides and consists essentially of a major proportion of a lithium iodide-potassium iodide mixture and a minor amount of at least one other alkali metal halide.

5. The method as in claim 4 wherein the other alkali metal halide is selected from lithium chloride, potassium chloride, and mixtures thereof.

6. The method as in claim 5 wherein the fused salt consists essentially of about 8 mole percent lithium chloride, about 42 mole percent potassium iodide, and about 50 mole percent lithium iodide.

7. A method for the production of lithium which comprises:

maintaining in a first electrolysis cell an aqueous solution of a lithium compound in contact with an anode and an amalgam of lithium as cathode;

maintaining in a second electrolysis cell a fused-salt which is molten at cell operating temperature and consists essentially of a mixture of at least two alkali halides as molten electrolyte in contact with a lithium amalgam and a cathode, the cathodic amalgam of the first cell serving as anodic amalgam of the second cell; and passing an electric current through the first and second cells by electrically contacting the anode of the first cell and the cathode of the second cell, thereby producing lithium at the cathode of the second cell.

8. The method as in claim 7 wherein the alkali metal halides are formed from ions selected from $Cs^+$, $Li^+$, $Na^+$, $K^+$, $F^-$, $Cl^-$, $Br^-$, and $I^-$.

9. The method as in claim 8 wherein the alkali metal halides are selected from lithium iodide, lithium chloride, potassium iodide, and potassium chloride.

10. The method as in claim 8 wherein the fused-salt is a mixture of at least three alkali metal halides and consists essentially of a major proportion of a lithium iodide-potassium iodide mixture and a minor amount of at least one other alkali metal halide.

11. The method as in claim 10 wherein the mixture of at least three alkali metal halides has a melting point below about 250° C.

12. The method as in claim 10 wherein the other alkali metal halide is selected from lithium chloride, potassium chloride, and mixtures thereof.

13. The method as in claim 12 wherein the fused-salt consists essentially of about 8 mole percent lithium chloride, about 42 mole percent potassium iodide, and about 50 mole percent lithium iodide.

14. The method as in claim 7 wherein the lithium compound is lithium hydroxide.

15. The method as in claim 7 further including the step of circulating the lithium amalgam between the first cell and the second cell in a manner so as to provide countercurrent heat transfer between an amalgam stream flowing to the first cell and an amalgam stream flowing to the second cell.

* * * * *